US009774089B2

(12) United States Patent
Tatarnikov et al.

(10) Patent No.: US 9,774,089 B2
(45) Date of Patent: Sep. 26, 2017

(54) IMPEDANCE HELICAL ANTENNA FORMING Π-SHAPED DIRECTIONAL DIAGRAM

(71) Applicant: LLC "TOPCON POSITIONING SYSTEMS", Moscow (RU)

(72) Inventors: Dmitry Vitalievich Tatarnikov, Moscow (RU); Ivan Miroslavovich Chernetsky, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 281 days.

(21) Appl. No.: 14/435,646

(22) PCT Filed: Oct. 7, 2014

(86) PCT No.: PCT/RU2014/000753

§ 371 (c)(1),
(2) Date: Apr. 14, 2015

(87) PCT Pub. No.: WO2016/056935

PCT Pub. Date: Apr. 14, 2016

(65) Prior Publication Data

US 2016/0268691 A1 Sep. 15, 2016

(51) Int. Cl.
*H01Q 11/08* (2006.01)
*H01Q 1/48* (2006.01)

(52) U.S. Cl.
CPC ..... *H01Q 11/08* (2013.01); *H01Q 1/48* (2013.01)

(58) Field of Classification Search
CPC ..... H01Q 11/08; H01Q 11/083; H01Q 11/086
See application file for complete search history.

(56) References Cited

U.S. PATENT DOCUMENTS

| | | | | |
|---|---|---|---|---|
| 2,958,081 | A | 10/1960 | Dyson | |
| 5,841,407 | A | 11/1998 | Birnbaum | |
| 6,160,523 | A | 12/2000 | Ho | |
| 6,334,048 | B1 * | 12/2001 | Edvardsson | H01Q 11/08 343/702 |
| 6,407,720 | B1 | 6/2002 | Josypenko | |
| 6,653,987 | B1 * | 11/2003 | Lamensdorf | H01Q 1/38 343/853 |

FOREIGN PATENT DOCUMENTS

JP 62032708 12/1987

OTHER PUBLICATIONS

Search Report in PCT/RU/2014/000753, dated Jun. 25, 2015.

* cited by examiner

*Primary Examiner* — Daniel J Munoz
(74) *Attorney, Agent, or Firm* — Bardmesser Law Group

(57) ABSTRACT

A quadrifilar helix antenna includes a cylindrical support extending along an antenna axis; a plurality of spiral antenna elements wrapped helically on the cylindrical support and along the antenna axis from a feed end to a remote end; a ground plane having a diameter of about 300 mm and perpendicular to the antenna axis; and each of the antenna elements including a plurality of breaks, with the breaks having capacitors between conducting portions of the antenna elements. All capacitors a positioned higher than 60 mm above the ground plane, and capacitance value varies inversely with height. The antenna exhibits a DU(10°)=−20 dB or better at an operating frequency $f_0$=1575 MHz. The diameter of the cylindrical support is 30 +/−5 mm. A total height of the cylindrical support is 300 +/−50 mm. A winding angle of the helix is variable.

17 Claims, 8 Drawing Sheets

IMPEDANCE HELICAL ANTENNA FORMING Π-SHAPED DIRECTIONAL DIAGRAM

BACKGROUND OF THE INVENTION

Field of the Invention

The present invention is related to antennas, and, more particularly, to helical antennas for use in GPS receivers.

Description of the Related Art

Multipath error is currently one of the most important contributions to the GNSS positioning error budget when a signal reflected from the underlying ground surface is received at the output of the receiving antenna along with the line-of-sight signal. Multipath error is proportional to the ratio $$DU(\theta) = \frac{F(-\theta)}{F(\theta)}.$$

This ratio is typically called Down/Up ratio. Here, $\theta$ is the elevation angle over the local horizon, and $F(+/-\theta)$ is the directional diagram (DD) for the antenna at angle $\theta$ over and under the local horizon respectively. To reduce multipath error, the value $F(-\theta)$ should be small. However, to provide stable and reliable operation of a positioning system, reception of all signals over the local horizon is needed.

Hence, to enhance accuracy of positioning systems, one needs to develop and design receiving antennas with Π-shaped (rectangular) DD providing antenna gain close to a constant value in the whole upper hemisphere and forming a sharp drop when crossing the local horizon downward.

Navigation signals are received from satellites in the upper hemi-sphere up to elevations 10° . . . 15° from the horizon. A signal reflected from the ground is fed from the lower hemi-sphere side. FIG. 1 shows a conditional division of space into upper (front) and lower (back) hemi-spheres, as well as a schematic diagram of the direct and reflected waves. To provide both navigation signal reception in the whole upper hemi-sphere and suppression of signals reflected from the ground, the antenna needs a high DD level in the upper hemi-sphere, a low DD level in the lower hemi-sphere, and a sharp drop of DD to the horizon direction.

A quadrifilar helix antenna is known (see Josypenko, CAPACITIVELY LOADED QUADRIFILAR HELIX ANTENNA, U.S. Pat. No. 6,407,720), with capacitive elements incorporated in spiral turns as shown in FIG. 2.

This antenna is produced as a dielectric cylinder 206 with mylar tapes 202, 203, 204, 205 being wound on it. The tapes are both-side-metallized, such that metallization areas 301-302–321-320 on different sides of the tape would be overlapped, forming capacitors C1-C19.

U.S. Pat. No. 6,407,720 discloses that the area of capacitor plates is maximum at excitation point 201 and then reduces according to the exponential law to the minimum value at the end of the spiral. One of the embodiments shows that the winding angle is constant and equal to 66.64° (see column 8, line 15 in U.S. Pat. No. 6,407,720).

In the proposed antenna this angle can be varied.

Known prior art solutions do not allow obtaining a sharp drop in DD in the direction of the horizon.

FIG. 4 shows an exemplary DD taken from U.S. Pat. No. 6,407,720. Unlike FIG. 1 the horizon direction is zero of elevation angles. The corresponding angles reading from the horizon (see FIG. 1) are in italics. In this figure, 401 is the directional diagram of a spiral antenna with turns in the form of simple metal tapes; 402 is the directional diagram of the spiral antenna with capacitor spiral turns (the subject matter of U.S. Pat. No. 6,407,720).

In FIG. 4: θ=0° is the direction to the local horizon; θ=10°, θ=−10° are the directions that differed by 10° from the horizon direction up and down respectively. DD values in the mentioned directions are: F(10°)=0.95, F(−10°)=0.85. Hence for the given antenna at the elevation of 10°, the Down/Up ratio is as follows: DU(10°)[dB]=20log[F(−10°)/F(10°)]=−0.97 dB, which is clearly inadequate for GPS applications, where at least −20 dB is required to suppress signals reflected from the ground.

SUMMARY OF THE INVENTION

The present invention is related to a helical antenna that substantially obviates one or several of the disadvantages of the related art.

The main purpose of this invention is to obtain a direction diagram with a sharp drop in the direction of the ground plane (i.e., the horizon direction) and maximum suppression of signals in the lower hemisphere due to selecting capacitive elements of the spiral antenna, spiral winding pitch, spiral diameter and height.

As such, a quadruple spiral antenna is proposed, where each spiral turn includes a set of capacitive elements. Note that U.S. Pat. No. 6,407,720 confirms that it does not provide a sharp drop of DD in the horizon direction, and U.S. Pat. No. 6,407,720 does not describe a directional diagram with a sharp drop in the horizon direction.

The present invention proposes a method of achieving such a sharp drop in the horizon direction due to special selection of capacitive elements as a part of the spiral turns. The operational bandwidth of the antenna is f=1575+/−40 MHz. Note that the antenna in U.S. Pat. No. 6,407,720 can operate at GPS frequencies with scaling, but the directional diagram's shape will be different and will not provide the required directional diagram drop at angles close to horizon.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 5A:
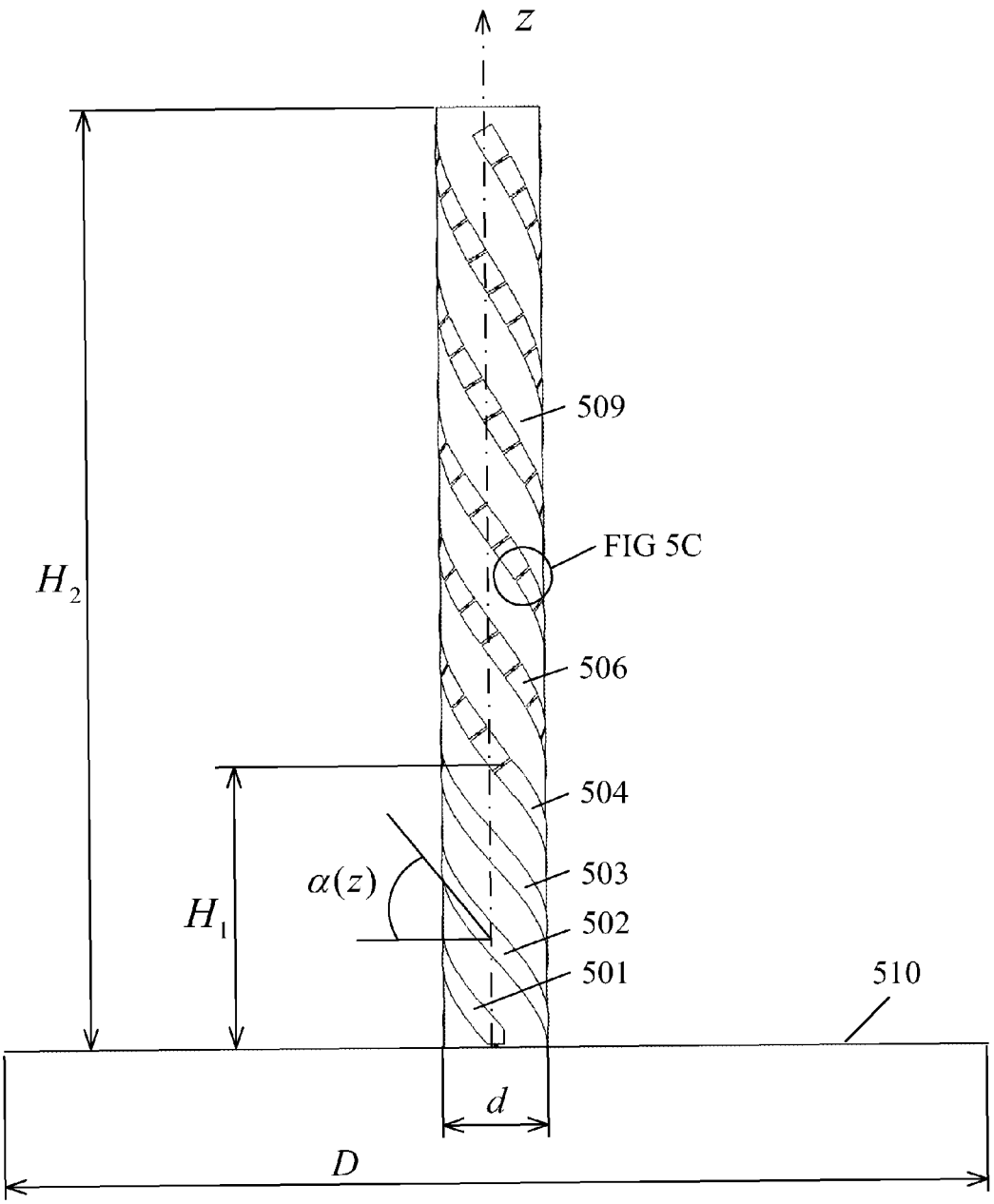
FIGS. 5A-5C show an embodiment of a design of a quadrifilar helix antenna.
Figure 5B:
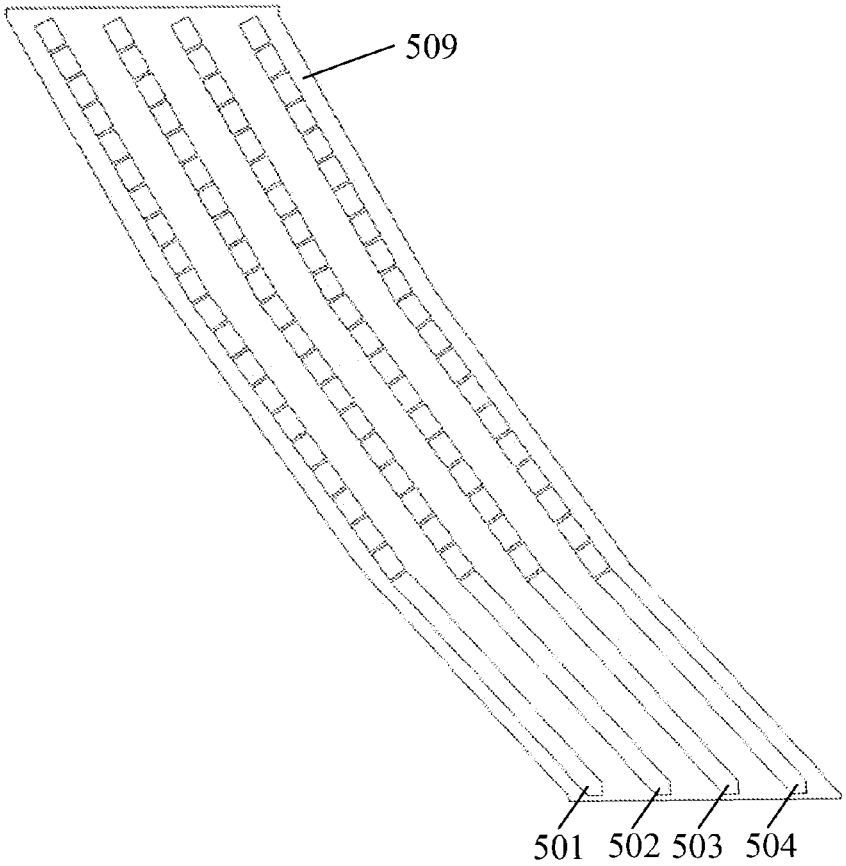
Figure 5C:
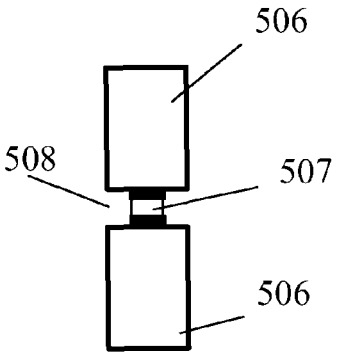

The proposed invention according to FIGS. 5A-5C is a quadrifilar cylindrical spiral antenna with capacitors soldered into breaks in metal turns.

The main features of the proposed antenna design are:

1. A quadruple spiral (FIGS. 5A, 5B) with capacitors soldered in-between breaks of spiral turns that is located onto a ground plane;
2. The diameter of the ground plane is selected such that a needed level of suppressing signals reflected from the ground in the nadir direction would be provided. In one of the embodiments, the diameter of the ground plane is 300 mm.;
3. The diameter of the spiral is D=30+/−5 mm.;
4. Total height of the spiral $H_2$ is $H_2$=300+/−50 mm.;
5. There is a free area with a height $H_1$ where there are no capacitors $H_1$=90+/−30 mm.;
6. A variable winding angle is equal to $$\alpha(z)=\alpha^*z+A, z=0 \ldots H_2, \text{ where} \quad (1)$$

$\alpha(z)$, [deg] is the winding angle;

$\alpha$=0.06±0.01[deg/mm];A=45±5[deg] are coefficients of the approximation equation for the winding angle;

7. Capacitors are loaded according to the following equation $$C_n = \begin{cases} —, & z = 0 \ldots H_1 \\ \dfrac{1}{2\pi f_0(b*z+B)h}, & z = H_1 \ldots H_2 \end{cases}, \text{ where} \quad (2)$$

$f_0$ is the central frequency of the operational band;

$C_n$, [pF] is the capacitance of the n-th capacitor;

z, [mm] is the vertical coordinate varying from zero at the beginning of the spiral and taking on discrete values: z=nh, where n is the number of capacitor position, h=5 . . . 30 [mm] is the pitch of arranging the capacitors along the vertical axis;

b=0.04±0.01[Ohm/mm$^2$]; B=1.5±0.3[Ohm/mm] are coefficients in the equation for calculating capacitors.

These values are optimal values to provide required directional diagram drop at angles close to horizon. The values depend from each other and allow adjusting antenna performance.

A PCB 509 is used for producing a spiral, with metallization areas 506 that can be manufactured by etching, for example. Between metallization areas there are breaks/slots 507. The produced PCB is then twisted to form a cylinder and fixed in this position.

Figure 1:
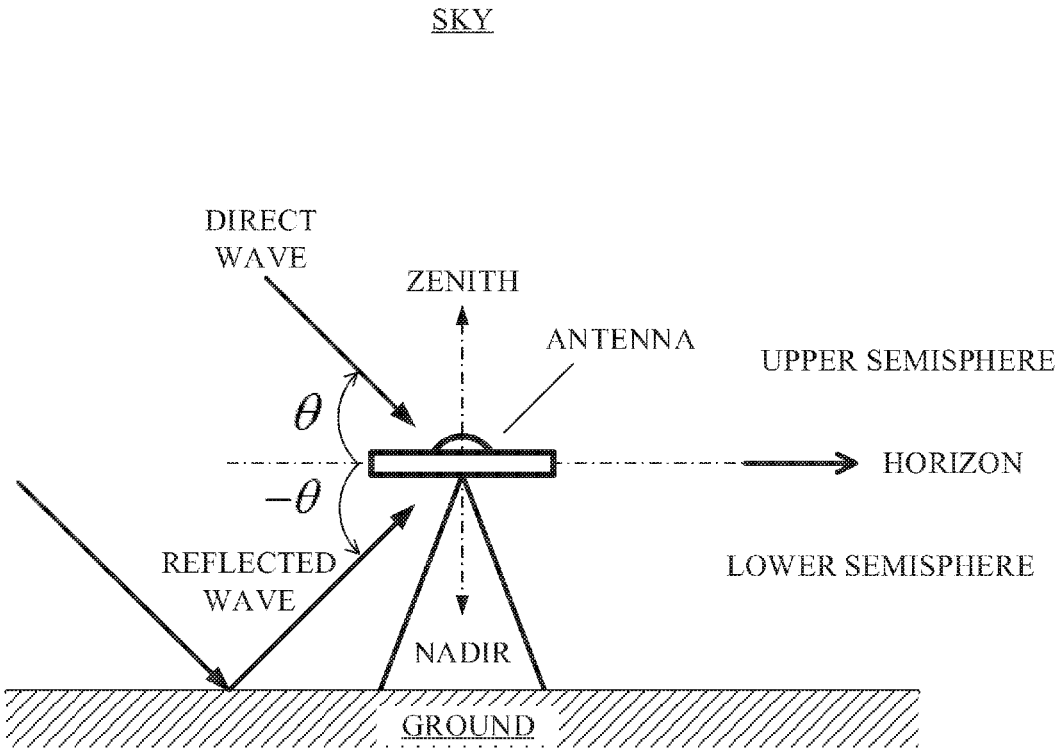
FIG. 1 shows a conditional division of space into the upper and lower hemispheres.
Figure 2:
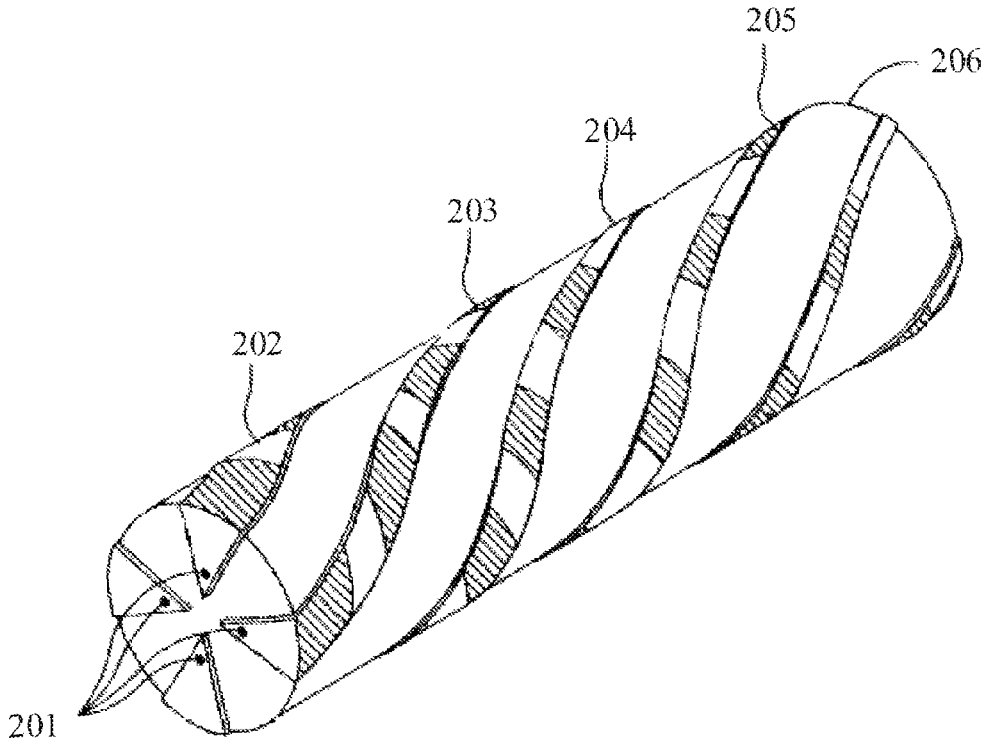
FIG. 2 shows an appearance of a prior art antenna.
Figure 3A:
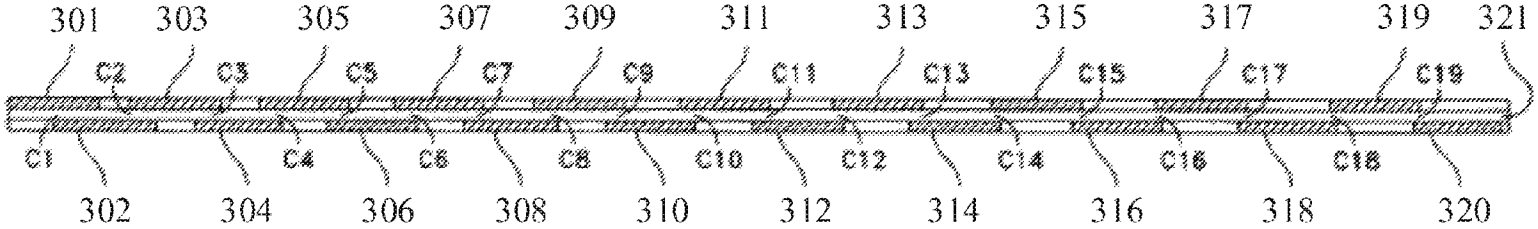
FIGS. 3A, 3B show a spiral turn of a prior art antenna.
Figure 3B:
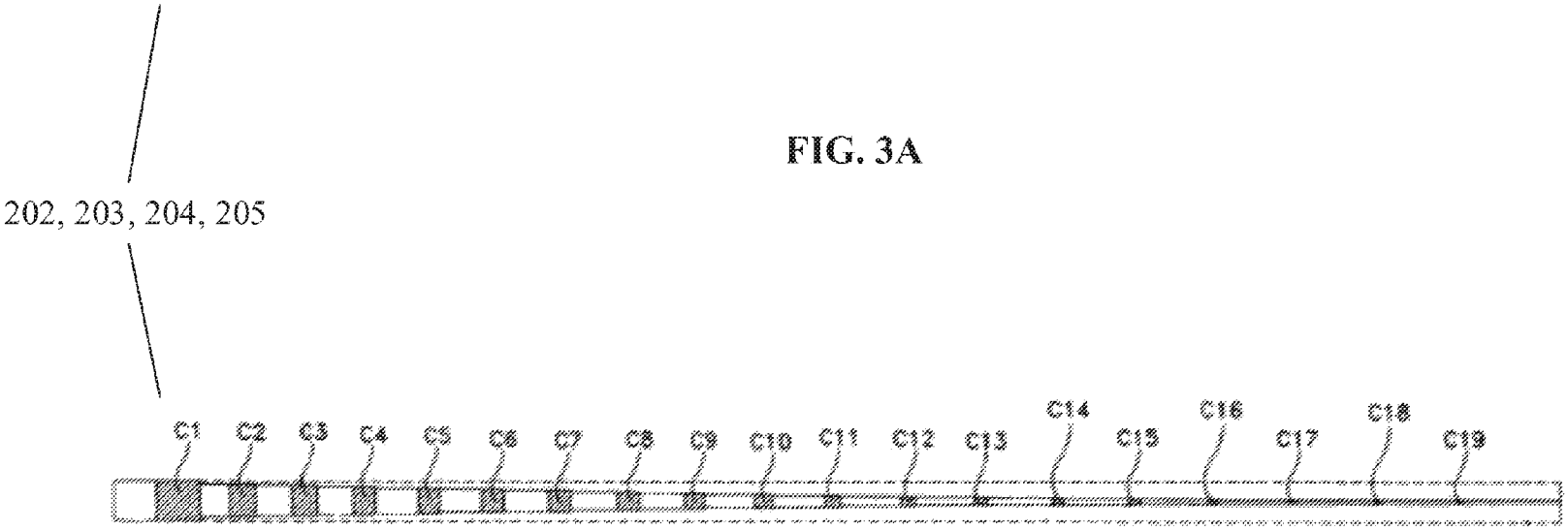
Figure 4:
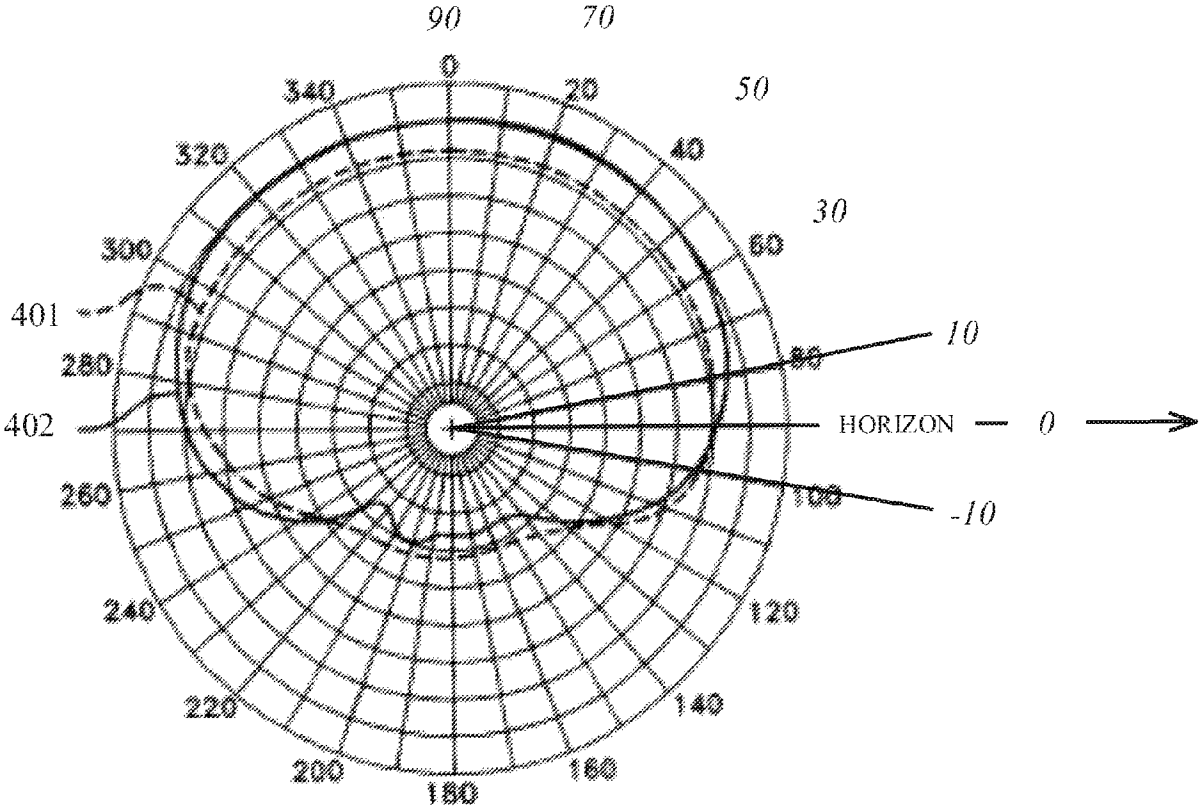
FIG. 4 shows a prior art antenna directional diagram.
Figure 6:
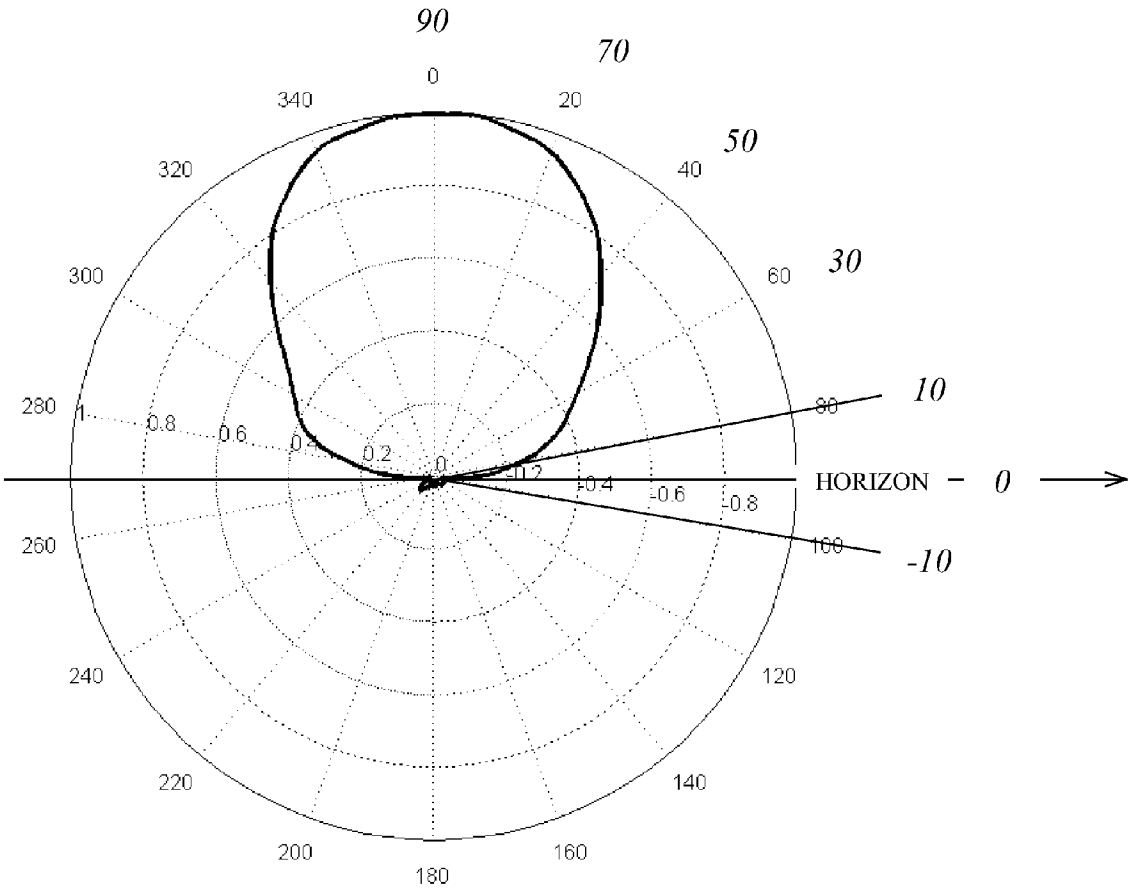
FIG. 6 shows a DD of the proposed antenna with a sharp drop to the horizon direction.

Capacitors 507 are soldered in breaks 508 between metallization areas 506. Spiral turns 501, 502, 503, 504 bare excited by pins (not shown in figures) passing through holes in the ground plane. The excitation circuit provides excitation of the right-hand circularly-polarized wave. FIG. 6 shows a directional diagram of the pilot antenna, which guarantees Down/Up ratio at least −20 dB at elevations θ≥10 degrees. At this, F(10°)=−11.5 dB. Similarly to FIG. 4, the angle zero is the zenith direction. The corresponding elevation angles read from the horizon (see FIG. 1) are in italics.

Figure 7:
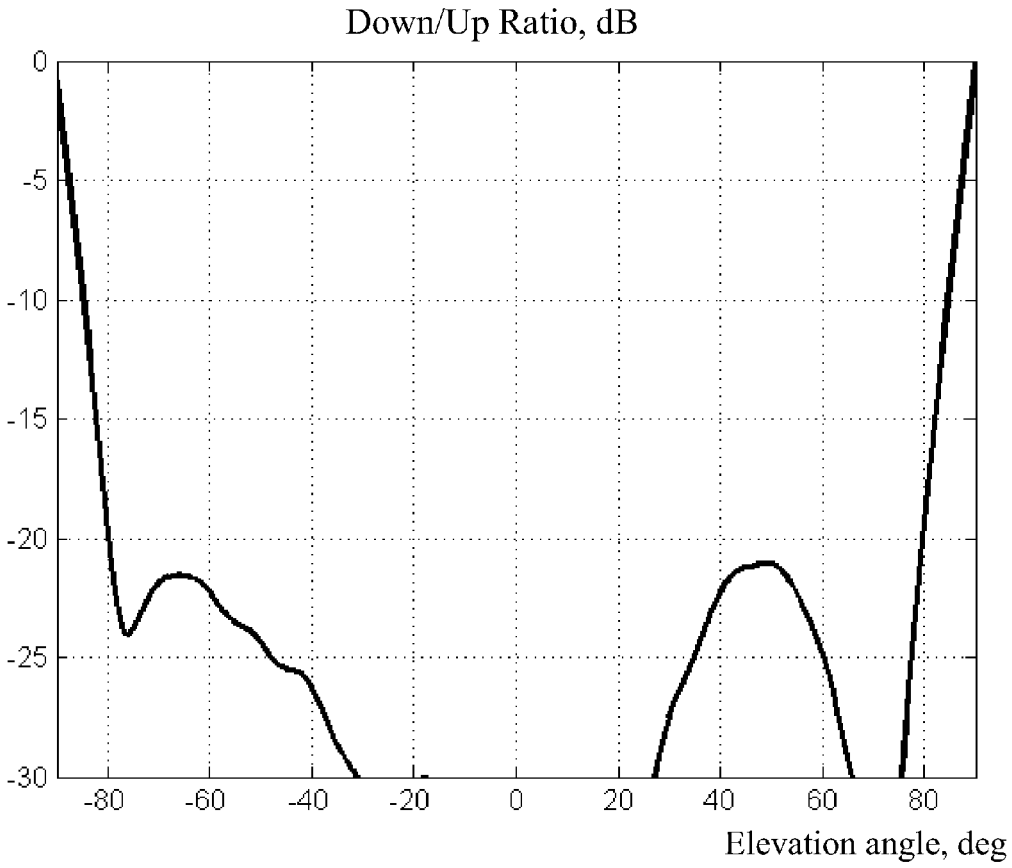
FIG. 7 shows a Down/Up graph of the proposed antenna.

FIG. 7 presents a graph of Down/Up ratio for the proposed antenna.

Having thus described a preferred embodiment, it should be apparent to those skilled in the art that certain advantages of the described method and apparatus have been achieved. It should also be appreciated that various modifications, adaptations and alternative embodiments thereof may be made within the scope and spirit of the present invention. The invention is further defined by the following claims.

What is claimed is:

1. A helix antenna comprising:

a cylindrical support extending along an antenna axis;

a plurality of spiral antenna elements wrapped helically on the cylindrical support and along the antenna axis from a feed end to a remote end;

a ground plane having a diameter of about 300 mm and perpendicular to the cylindrical support; and each of the antenna elements including a plurality of breaks, with the breaks having capacitors between conducting portions of the spiral antenna elements, wherein all capacitors are positioned higher than a height $H_1$=90±30 mm above the ground plane, wherein values of the capacitors of each antenna element are $$C_n = \begin{cases} —, & z = 0 \ldots H_1 \\ \dfrac{1}{2\pi f_0(b*z+B)h}, & z = H_1 \ldots H_2 \end{cases},$$

where $C_n$ (in pF) is a capacitance of the n-th capacitor;

z (in mm) is a vertical coordinate varying from zero at a beginning of the spiral antenna element and taking on discrete values z=nL, where n is the number of capacitor position, L=5 . . . 30 (in mm) is a constant representing distance (center to center) between adjacent capacitors, $H_2$ is a total height of the cylindrical support, and b=0.04±0.01 (in Ohm/mm$^2$), B=1.5±0.3 (in Ohm/mm), wherein a winding angle α of the helix is variable and calculated as $\alpha(z)=\alpha^*z+A$, z=0 . . . $H_2$, where α(z) (in deg) is the winding angle, and a=0.06±0.01 (in deg/mm), A=45°±5° are coefficients of an approximation equation for the winding angle, and wherein the antenna exhibits a Down-Up ratio of DU(10°)=−20 dB or better at an operating frequency $f_0$=1575±40 MHz.

2. The helix antenna of claim 1, wherein the plurality of spiral antenna elements includes four antenna elements.

3. The helix antenna of claim 1, wherein a diameter of the cylindrical support is D=30±5 mm.

4. The helix antenna of claim 1, wherein a total height of the cylindrical support $H_2$ is $H_2$=300±50 mm.

5. A multifilar helix antenna comprising:

a cylindrical support extending along an antenna axis;

a plurality of spiral antenna elements wrapped helically on the cylindrical support and along the antenna axis from a feed end to a remote end;

a ground plane having a diameter of about 300 mm and perpendicular to the antenna axis; and each of the spiral antenna elements including a plurality of breaks, with the breaks having capacitors between conducting portions of the antenna elements, wherein all capacitors are positioned higher than a height $H_1$=90±30 mm above the ground plane, and wherein values of the capacitors of each antenna element are $$C_n = \begin{cases} —, & z = 0 \ldots H_1 \\ \dfrac{1}{2\pi f_0(b*z+B)h}, & z = H_1 \ldots H_2 \end{cases},$$

where $C_n$ (in pF) is a capacitance of the n-th capacitor;

z (in mm) is a vertical coordinate varying from zero at a beginning of the spiral antenna elements and taking on discrete values z=nL, where n is the number of capacitor position, L=5 . . . 30 mm is a constant representing center-to-center distance between adjacent capacitors, $H_2$ is a total height of the cylindrical support, b=0.04±0.01 (in Ohm/mm$^2$), B=1.5±0.3 (in Ohm/mm), wherein a winding angle α of the helix is variable and calculated as α(z)=α*z+A, z=0 . . . $H_2$ where α(z) (in deg) is the winding angle, and a=0.06±0.01 (in deg/mm), A=45°±5° are coefficients of an approximation equation for the winding angle, and $f_0$ is an operating frequency.

6. The helix ante a of claim 5, wherein the plurality of spiral antenna elements includes four antenna elements.

7. The helix antenna of claim 5, wherein a diameter of the cylindrical support is D=30±5 mm.

8. The helix antenna of claim 5, wherein a total height of the cylindrical support $H_2$ is $H_{2=}$300±50 mm.

9. The helix antenna of claim 5, wherein the ground plane has a diameter of about 300 mm.

10. The helix antenna of claim 5, wherein the antenna exhibits a Down-Up ratio of DU(10°)=−20 dB or better at an operating frequency $f_0$=1575±40 MHz.

11. A helix antenna comprising:

a cylindrical support extending along an antenna axis;

a plurality of spiral antenna elements wrapped helically on the cylindrical support and along the antenna axis from a feed end to a remote end;

a ground plane having a diameter of about 300 mm and perpendicular to the cylindrical support; and each of the spiral antenna elements including a plurality of breaks, with the breaks having capacitors between conducting portions of the spiral antenna elements, wherein all capacitors are positioned higher than a height $H_1$=60 mm above the ground plane, wherein values of the capacitors of each spiral antenna element are given by $$C_n = \frac{1}{2\pi f_0(b*z+B)L},$$

where $C_n$ is a capacitance of the n-th capacitor;

z is a vertical coordinate with discrete values z=nL, where n is the number of capacitor position, L is a constant distance (center to center) between adjacent capacitors of the spiral antenna element, and B and b are constants, wherein a winding angle α(z) of the helix is α(z)=E*z+A, where E and A are constants, and wherein the antenna has a Down-Up ratio of −20 dB or better 10° at an operating frequency 1535<$f_0$ <1615 MHz.

12. The helix antenna of claim 11, wherein a total height of the cylindrical support $H_2$ is 300±50 mm.

13. The helix antenna of claim 11, wherein L=5 . . . 30 mm.

14. The helix antenna of claim 11, wherein b=0.04±0.01 (in Ohm/mm$^2$).

15. The helix antenna of claim 11, wherein B=1.5±0.3 (in Ohm/mm).

16. The helix antenna of claim 11, wherein the ground plane has a diameter of about 300 mm.

17. The helix antenna of claim 11, wherein E=0.06°/mm ±0.01°/mm, and A =45°±5°.

* * * * *